US006296578B1

(12) United States Patent
Masutani

(10) Patent No.: US 6,296,578 B1
(45) Date of Patent: Oct. 2, 2001

(54) GOLF BALL

(75) Inventor: Yutaka Masutani, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/546,520

(22) Filed: Apr. 11, 2000

(30) Foreign Application Priority Data

Apr. 12, 1999 (JP) ..... 11-103753

(51) Int. Cl.[7] ..... A63B 37/06; A63B 37/08; A63B 37/04

(52) U.S. Cl. ..... 473/368; 473/367; 473/370; 473/371; 473/373; 473/374; 473/376

(58) Field of Search ..... 473/351, 367, 473/368, 370, 371, 374, 376, 377, 378

(56) References Cited

U.S. PATENT DOCUMENTS 4,267,217 * 5/1981 Brooker ..... 428/11
5,692,973 * 12/1997 Dalton ..... 473/374
5,820,485 10/1998 Hwang ..... 473/361
5,836,834 * 11/1998 Masutani et al. ..... 473/374
5,882,567 3/1999 Cavallaro et al. ..... 264/255
5,984,807 * 11/1999 Wai et al. ..... 473/376
6,066,054 * 5/2000 Masutani ..... 473/374
6,155,935 * 12/2000 Maruko ..... 473/361
6,168,407 * 1/2001 Kasashima et al. ..... 425/116

* cited by examiner

*Primary Examiner*—Jeanette Chapman
*Assistant Examiner*—Alvin A. Hunter, Jr.
(74) *Attorney, Agent, or Firm*—Sughrue, Mion, Zinn, Macpeak & Seas, PLLC

(57) ABSTRACT

A golf ball comprising: a spherical elastic core; an inner cover comprising a resin; and an outer cover comprising a relatively hard resin or rubber and having dimples in an outer surface thereof, wherein the inner cover defines a large number of small holes disposed and substantially evenly dispersed in a periphery thereof, wherein the outer cover has protrusions which extend from an inner surface thereof into the small holes in the inner cover to conform with the small holes, and wherein the interface formed between the inner cover and the outer cover includes a relatively rough interface circumferentially extending along an outer surface of the inner cover and a relatively smooth interface radially extending along wall faces of the small holes.

17 Claims, 2 Drawing Sheets

GOLF BALL

FIELD OF THE INVENTION

The present invention relates to an improvement of a solid type golf ball excellent in carrying characteristic.

BACKGROUND OF THE INVENTION

Golf balls are generally classified into rubber thread type golf balls and solid type golf balls. The rubber thread type golf ball is formed such that a core of a rubber thread wound up into a sphere is covered with a balata cover. The solid type golf ball is formed such that a spherical core made of hard rubber having a high restitution coefficient is covered with a resin cover excellent both in tear resistance and in wear resistance. The latter type golf ball is overwhelmingly popular with golfers because it is excellent in carrying distance.

However, the solid type golf ball has problems, for example, such that it gives a relatively hard feeling at the time of hitting and that it is difficult to give it the required amount of a spin by hitting with a short iron. Thus, there is still room for improvement in the solid type golf ball. As measures against these problems, the following examples of improvement are known A first one of the examples is a structure in which a relatively thin intermediate layer made of a resin having lower hardness than a cover is disposed between the core and the cover, or two intermediate layers made of such a resin are disposed as occasion demands.

A second one is applied to the above mentioned-structure in which a resin intermediate layer is disposed between the core and the cover. For example, as described in JP-A-10-216270, small protrusions are provided on the whole surface of the intermediate layer (hereinafter referred to as "inner cover") and the outside of the inner cover is covered with the cover (hereinafter referred to as "outer cover"). As a structure similar to this, there is also a proposal of a structure in which small protrusions are provided on an inner circumferential surface of the outer cover so as to protrude into the inner cover. Also in this case, a resin material having lower hardness than the outer cover is generally used for the inner cover. When such protrusions are provided on the inner cover, the height of the protrusions is often set to be slightly smaller than the thickness of the outer cover. When such protrusions are provided on the outer cover side, the height of the protrusions is often set to be slightly smaller than the thickness of the inner cover. As a result, the outer cover material is interposed between adjacent protrusions extended from the inner cover or the inner cover material is interposed between adjacent protrusions extended from the outer cover. Hence, when the golf ball is viewed radially, a third layer having mixed properties of the outer cover and the inner cover is substantially present at the location of the small protrusions.

Such a multi-structure solid type golf ball constituted by a core, an inner cover and an outer cover is generally formed as follows. That is, a rubber material is put into a mold and vulcanized into a spherical core. Then, the spherical core is shifted into an inner cover-forming mold and a thermoplastic resin is injected into the mold. Thus, the outside of the core is covered with the thermoplastic resin so that an inner cover is formed. Then, the core covered with the inner cover is further shifted into an outer cover-forming mold and a similar thermoplastic resin is injected into the mold. Thus, the formation of the golf ball exhibiting the external appearance as a final product is completed.

In the golf ball thus formed, faces between adjacent constituent layers are in tight contact with one another but not adhesively bonded to one another. Particularly when such a ball in which faces between laminated layers are not adhesively bonded to one another is hit by a club having a large loft angle, there is a defect that it is difficult to give an expected spin to the ball because of loss occurring in shear stress generated in the ball. The tendency to a lower spin based on the loss in the shear stress is exhibited more remarkably in a portion near the surface of the ball and between the inner cover and the outer cover. In this respect, the interposition of the aforementioned small protrusions between the inner cover and the outer cover can improve mechanical connection therebetween but is not satisfactorily reflected in spinning characteristic.

SUMMARY OF THE INVENTION

The present invention is to solve the above-described problems.

That is, an object of the present invention is to provide a golf ball excellent in carrying characteristic in which the degree of tight contact between an inner cover and an outer cover is changed in accordance with the direction of an acting force to the golf ball, so that high spinning characteristic can be obtained when the ball is hit by a club requiring a higher spin whereas a large carrying distance can be obtained with a lower spin when the ball is hit by a club requiring a larger carrying distance.

Other objects and effects of the present invention will become apparent from the following description.

The above-described objects of the present invention have been achieved by providing the following golf ball.

A golf ball comprising:

a spherical elastic core;

an inner cover comprising a resin; and an outer cover comprising a relatively hard resin or rubber and having dimples in an outer surface thereof, wherein said inner cover defines a large number of small holes disposed and substantially evenly dispersed in a periphery thereof, wherein said outer cover has protrusions which extend from an inner surface thereof into said small holes in said inner cover to conform with said small holes, and wherein the interface formed between said inner cover and said outer cover includes a relatively rough interface circumferentially extending along an outer surface of said inner cover and a relatively smooth interface radially extending along wall faces of said small holes.

In the present invention, the diameter of each of the small holes provided in the inner cover is preferablly from 0.8 mm to 3.0 mm, more preferably from 1.0 mm to 2.0 mm.

Further, the small holes are provided as through-holes which reach the core. Preferably, the small holes are disposed substantially evenly on the circumference of the inner cover. The number of the small holes is preferably from 50 to 500, more preferably from 150 to 400.

Preferably, roughness having a depth of from 0.01 mm to 0.2 mm are formed on the circumferential surface (circumferential interface) between the inner and outer covers whereas wall surfaces of the small holes filled with the protrusions respectively are formed smoothly.

DESCRIPTION OF THE PREFERRED EMBODIMENT

Preferred embodiments of the present invention are described below with reference to the drawings.

Figure 1:
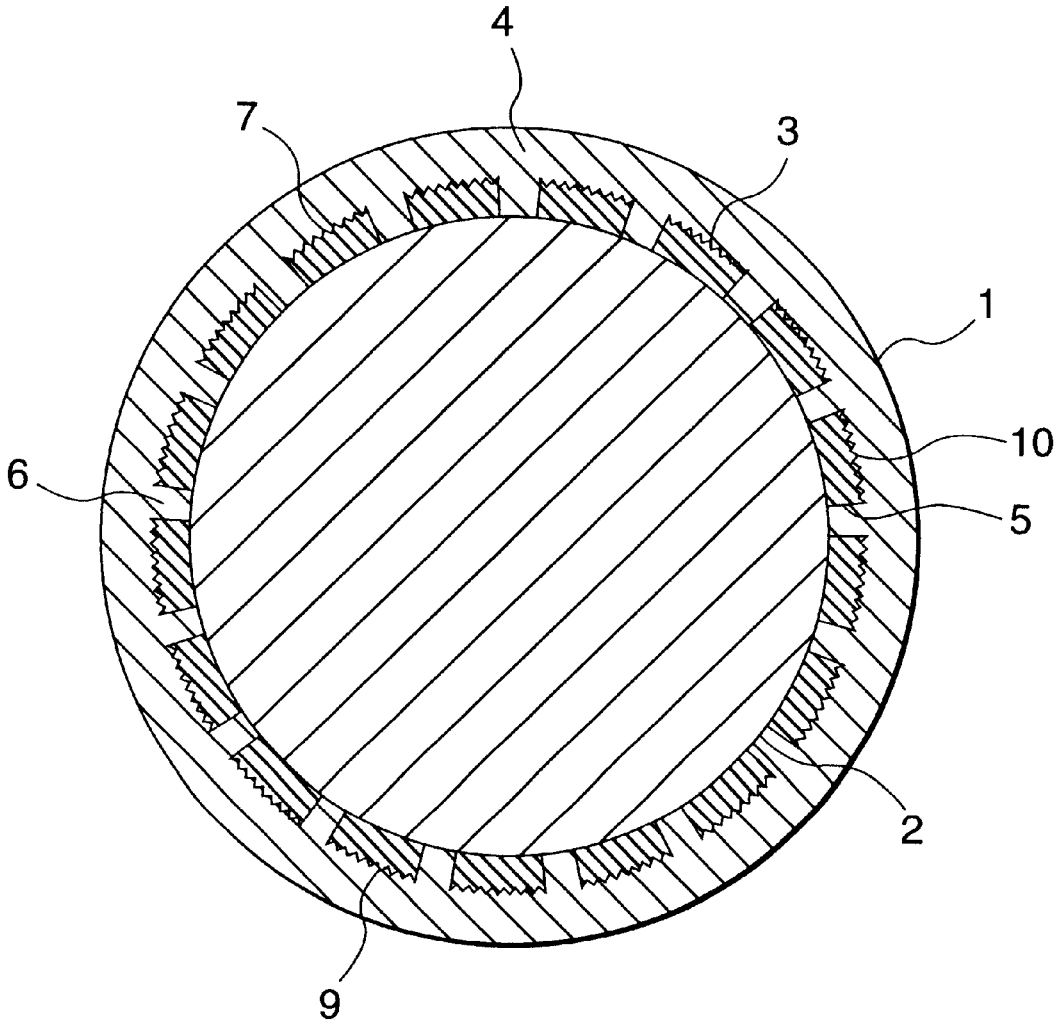
FIG. 1 is a sectional view of a golf ball showing an embodiment of the present invention.

Referring to FIG. 1, the golf ball 1 is constituted by a core 2 occupying the center portion of the ball, an inner cover 3 and an outer cover 4 which cover the core 2 successively. Though not shown, a large number of dimples are formed on the outer surface of the outer cover 4 by an ordinary method.

There is no particular limitation about the material for the core 2. For example, vulcanized rubbers mainly comprising a polybutadiene rubber, a polyisoprene rubber, a natural rubber, a silicone rubber or the like can be used. To increase resilience property, it is preferable to use vulcanized rubber containing a polybutadiene rubber or a polyisoprene rubber as a main component. In this embodiment, a polybutadiene rubber is used as the material for the core 2. The hardness of the core 2 is preferably from 2 mm to 6 mm in terms of the quantity of deformation as measured by applying a load of 100 kg thereto the core 2. In this embodiment, the quantity of deformation is 2.9 mm.

There is also no particular limitation about the material for the inner cover 3. Polyester elastomers, ionomer resins, urethane-based resins, styrene-based elastomers, hydrogenated butadiene resins or the like can be used as a main component of the material in view of durability because they have strong impact resistance. In this embodiment, a polyester elastomer is used.

The hardness of the inner cover 3 in terms of Shore D hardness is generally from 10° to 55°, preferably from 15° to 40°. In this embodiment, the hardness is 30°.

The thickness of the inner cover 3 is preferably from 0.5 mm to 5.0 mm, more preferably from 1.0 mm to 3.0 mm. In this embodiment, the thickness is 1.8 mm.

Ionomer resins, urethane-based resins, polyester-based resins, balata rubber or the like can be used as a main material for the outer cover 4 because they are excellent both in wear resistance and in cut resistance. In this embodiment, a material containing ionomer resin as a main component is used.

The hardness of the outer cover 4 in terms of Shore D hardness is generally from 40° to 700°, preferably from 50° to 650°. Preferably, the hardness of the outer cover 4 is higher than that of the inner cover. In this embodiment, the hardness of the outer cover 4 is 55°.

The thickness of the outer cover 4, excluding the height of protrusions described below, is from 0.5 mm to 4.0 mm. In this embodiment, the thickness is 1.8 mm.

Figure 2:
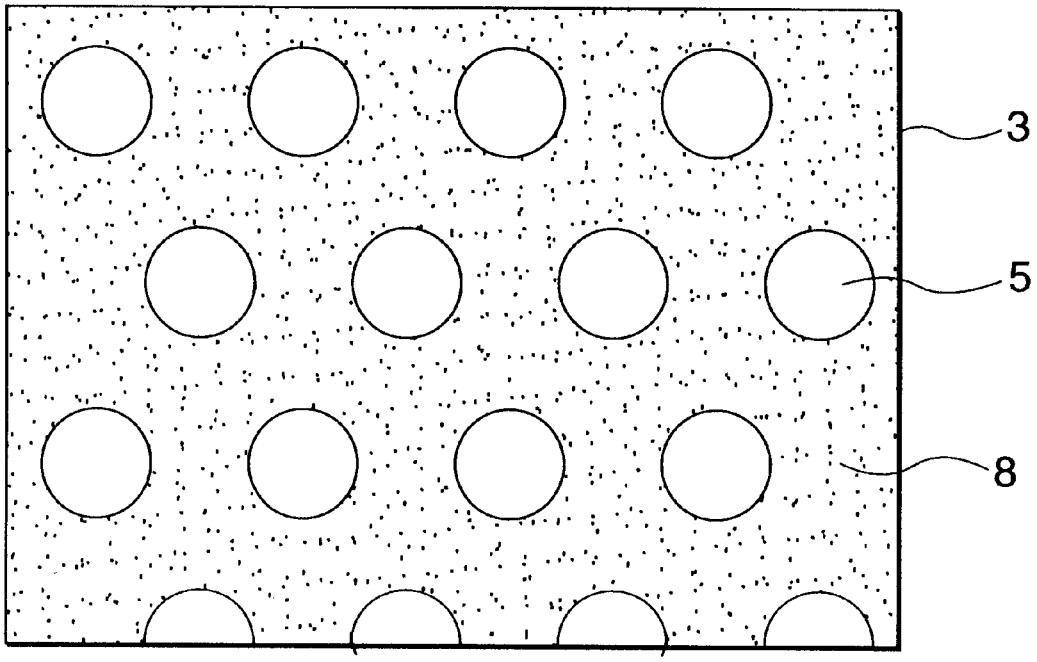
FIG. 2 is an enlarged plan view of an inner cover of the ball depicted in FIG. 1.

Small holes 5 are disposed substantially evenly over the whole circumference of the inner cover 3 (FIG. 2). The number of the small holes 5 is generally from 50 to 500, preferably from 150 to 400. Parts of the outer cover are introduced into these small holes 5 to fill and conform therewith. Thus, protrusions 6 are formed. The shape of each of the small holes may be like a cylinder shape with the largest diameter of from 0.5 mm to 4.0 mm, like a cone shape tapered toward the center of the ball or like a truncated cone tapered in the aforementioned manner. The depth of each of the small holes is generally from 50% to 100%, preferably from 70% to 100%, of the thickness of the inner cover. The depth of the small holes substantially corresponds to the height of the protrusions of the outer cover. In this embodiment, 250 cylindrical through-holes (100% deep) each having a diameter of 1.6 mm are disposed so as to reach the surface of the core 2.

Roughness 10 generally having a depth of from 0.01 mm to 0.2 mm is provided on the outer surface 8 of the inner cover 3. Parts of the inner surface 9 of the outer cover overlapping the inner cover enters the inner cover 3 so as to be fitted to the rough surface so that rough interfaces between the inner and outer covers are formed.

When roughness is to be formed on the surface 8 of the inner cover, a rough surface may be printed on the outer surface of the inner cover at the time of covering the core by use of a mold having an inner wall surface subjected to a roulette finishing, a shot blast finishing such as sandblasting or the like, or any kind of polishing finishing. Alternatively, the core-containing inner cover may be formed by use of a mold having a smooth inner wall surface, and an irregular or rough surface may be provided on the inner cover, for example, by such a manner that the core-containing inner cover is put in a ball mill in which a sheet of sandpaper or a whetstone having a required roughness is stuck on the inner wall, and then that ball mill is rotated or by means such as centerless grinding, barrel-polishing, shot blasting such as sandblasting or the like. In this case, it is necessary to keep (or form) the wall surface of each of the small holes in a smooth state. In this embodiment, centerless grinding is applied to the core-containing inner cover so that roughness about 0.1 mm deep are provided on the whole surface 8 of the inner cover. The interface between the inner surface of the outer cover and the outer surface of the inner cover having roughness was examined by dissection after a test was undergone in a manner as described below. As a result, the interface of the outer and inner covers was integrated so as to be fitted to the roughness 10 of the inner cover.

The aforementioned embodiment of the present invention (Example 1) and three kinds of comparative examples were evaluated by an impact test using a robot.

TABLE 1

| | | Example 1 | Comparative Example 1 | Comparative Example 2 | Comparative Example 3 |
|---|---|---|---|---|---|
| Core | Material | Rubber (BR) | Rubber (BR) | Rubber (BR) | Rubber (BR) |
| | Hardness (mm) | 2.9 | 2.9 | 2.9 | 2.9 |
| Inner Cover | Material | Polyester | Polyester | Polyester | Polyester |
| | Thickness (mm) | 1.7 | 1.7 | 1.7 | 1.7 |
| | Hardness (°) | 30 | 30 | 30 | 30 |
| | Number of Small Holes | 250 | 250 | 250 | None |
| | Small Hole Diameter (mm) | 1.6 | 1.6 | 1.6 | — |
| | Small Hole Depth (mm) | 1.7 | 1.7 | 1.7 | — |
| | Surface State | A | B | C | D |
| Outer Cover | Material | Ionomer | Ionomer | Ionomer | Ionomer |
| | Hardness (°) | 55 | 55 | 55 | 55 |
| | Thickness (mm) | 1.8 | 1.8 | 1.8 | 1.8 |

Note:
A . . . An irregular rough surface having a mean roughness of 0.1 mm was formed only on the circumferential surface by centerless grinding.
B . . . An irregular rough surface having a mean roughness of 0.1 mm was formed both on the circumferential surface and on the wall surfaces of the small holes by sandblasting.
C . . . There was no grinding (both the circumferential surface and the wall surfaces of the small holes were smooth).
D . . . An irregular rough surface having a mean roughness of 0.1 mm was formed on the circumferential surface by centerless grinding.

Incidentally, Comparative Examples 1 and 2 were formed in the same manner as Example 1 of the present invention except the surface state of the inner cover as described in the above note. The comparative example 3 was formed in the same manner as Example 1 of the present invention except the absence of the small holes and the aforementioned surface state.

TABLE 2

| | | Example 1 | Comparative Example 1 | Comparative Example 2 | Comparative Example 3 |
|---|---|---|---|---|---|
| W1 | Spin (rpm) | 2348 | 2480 | 2403 | 2451 |
| HS45 | Carry (m) | 215 | 213 | 214 | 213 |
| | Total(m) | 224 | 221 | 218 | 217 |
| SW | Spin (rpm) | 4923 | 4680 | 4423 | 4275 |
| HS25 | | | | | |

In Table 2, W1 designates a number-1 wood (driver); SW, a sand wedge; HS45, a head speed of 45 m/s; and HS25, a head speed of 25 m/s.

Thus, the dependency on the loft angle of a club is advantageously improved with the golf ball according to the present invention, as demonstrated in the test results shown in Table 2.

More specifically, the degree of tight contact between the inner and outer covers which cover the elastic core is improved through a circumferential rough contact interface. Hence, required spinning characteristic is improved when the ball is hit by a club having a large loft angle. On the other hand, a smooth interface is formed between the small holes provided in the inner cover and the protrusions provided on the outer cover so that the inside of the small holes is filled with the protrusions. Hence, when the ball is hit by a club having a small loft angle, the radial deformation of the ball mainly subjected to the hitting is not restricted physically substantially with respect to the interface between the inner and outer covers. Therefore, the deformation of the relatively soft inner cover has a large influence on the radial deformation of the ball. That is, the deformation of the ball due to impact is increased. Consequently, the quantity of spin is reduced and repulsion is increased, so that the carrying distance is improved advantageously.

While the invention has been described in detail and with reference to specific embodiments thereof, it will be apparent to one skilled in the art that various changes and modifications can be made therein without departing from the spirit and scope thereof.

What is claimed is:

1. A golf ball comprising:

a spherical elastic core;

an inner cover comprising a resin; and an outer cover comprising a relatively hard resin or rubber and having dimples in an outer surface thereof, wherein said inner cover defines a large number of small holes disposed and substantially evenly dispersed in a periphery thereof, wherein said outer cover has protrusions which extend from an inner surface thereof into said small holes in said inner cover to conform with said small holes, and wherein the interface formed between said inner cover and said outer cover includes a relatively rough interface circumferentially extending along an outer surface of said inner cover and a relatively smooth interface radially extending along wall faces of said small holes.

2. The golf ball according to claim 1, wherein each of said small holes defined in said inner cover has a diameter of from 0.8 mm to 3 mm.

3. The golf ball according to claim 2, wherein said relatively rough interface has roughness having a depth of from about 0.01 mm to about 0.2 mm.

4. The golf ball according to claim 1, wherein each of said small holes defined in said inner cover is a through-hole.

5. The golf ball according to claim 4, wherein said relatively rough interface has roughness having a depth of from about 0.01 mm to about 0.2 mm.

6. The golf ball according to claim 1, wherein the number of said small holes defined in said inner cover is from 50 to 500.

7. The golf ball according to claim 6, wherein said relatively rough interface has roughness having a depth of from about 0.01 mm to about 0.2 mm.

8. The golf ball according to claim 1, wherein said relatively rough interface has roughness having a depth of from about 0.01 mm to about 0.2 mm.

9. The golf ball according to claim 1, wherein said core has a hardness of from 2 mm to 6 mm in terms of the quantity of deformation as measured by applying a load of 100 kg thereto the core 2.

10. The golf ball according to claim 1, wherein said inner cover has a Shore D hardness of from 10° to 55°.

11. The golf ball according to claim 1, wherein said inner cover has a thickness of from 0.5 to 5 mm.

12. The golf ball according to claim 1, wherein said outer cover has a Shore D hardness of from 40° to 70°.

13. The golf ball according to claim 1, wherein said outer cover has a thickness, excluding said protrusions, of from 0.5 to 4.0 mm.

14. The golf ball according to claim 1, wherein said outer cover has a hardness higher than that of the inner cover.

15. The golf ball according to claim 1, wherein said small holes each has a cylinder shape having a largest diameter of from 0.5 mm to 4.0 mm.

16. The golf ball according to claim 1, wherein said small holes each has a cone shape tapered toward the center of the ball.

17. The golf ball according to claim 1, wherein said small holes each has a truncated cone shape tapered toward the center of the ball.

* * * * *